US007225748B2

(12) United States Patent
Caspi et al.

(10) Patent No.: US 7,225,748 B2
(45) Date of Patent: Jun. 5, 2007

(54) STEALTHY POWERED CATAMARAN

(75) Inventors: Yuval Caspi, Granada Hills, CA (US); Stephen Kong, Tuen Mun (HK); Brady Aaron Lang, Los Angeles, CA (US)

(73) Assignee: MGA Entertainment, Van Nuys, CA (US)

( * ) Notice: Subject to any disclaimer, the term of this patent is extended or adjusted under 35 U.S.C. 154(b) by 0 days.

(21) Appl. No.: 11/323,911

(22) Filed: Dec. 30, 2005

(65) Prior Publication Data

US 2006/0236909 A1 Oct. 26, 2006

Related U.S. Application Data

(60) Provisional application No. 60/640,909, filed on Dec. 31, 2004.

(51) Int. Cl.
*B63B 1/00* (2006.01)

(52) U.S. Cl. ..... 114/61.16; 114/61.18

(58) Field of Classification Search ..... 114/61.15, 114/61.16, 61.17, 61.18
See application file for complete search history.

(56) References Cited

U.S. PATENT DOCUMENTS 1,344,903 A * 6/1920 Koiransky ..... 114/61.16
5,277,142 A * 1/1994 Connor ..... 114/61.16
6,564,735 B1 * 5/2003 Jackson ..... 114/61.1

* cited by examiner

*Primary Examiner*—Stephen Avila
(74) *Attorney, Agent, or Firm*—Irell & Manella LLP

(57) ABSTRACT

An articulated boat may include a pair of pontoons and a central cabin connected by pair of struts, each pair forming a parallelogram and one or more motors for changing the elevation between the central cabin and the pair of pontoons and for moving the boat through the water. The motors may be operated by remote control.

14 Claims, 6 Drawing Sheets

STEALTHY POWERED CATAMARAN

CROSS REFERENCE TO RELATED APPLICATIONS

This application claims the priority of U.S. Provisional application entitled "Stealthy Powered Catamaran", Ser. No. 60/640,909, filed Dec. 31, 2004.

BACKGROUND OF THE INVENTION

1. Field of the Invention

This invention is related to watercraft and particularly to powered catamarans.

2. Description of the Prior Art

Conventional powered catamarans have significant visual and radar signatures, similar to monohull craft of a similar size.

What is needed is a watercraft configuration that provides enhanced abilities to limit their visual and radar signatures and to improve the utility of such vehicles in military, civilian and toy configurations.

SUMMARY OF THE INVENTION

An articulated boat may include a pair of pontoons, a central cabin and two pairs of struts mounting the cabin to the pontoons, each pair of struts forming a parallelogram, a second pair of struts mounted at one end to a third pair of pivot points separated by a third distance along another portion of the central cabin, the second pair of struts mounted at another end to a pair of pivot points separated by a fourth distance along a first portion of the other one of the pontoons, the second pair of struts and the third and fourth distances and second distances forming a parallelogram, one or more motors for changing an elevation between the central cabin and the pair of pontoons and a fifth distance between the pontoons and a pair of engines for moving the boat through the water.

A method of operating a boat may include providing a pair of pontoons connected to a central cabin by two pairs of parallel struts, each pair forming a parallelogram with a section of the central cabin and a section of the pontoon across which each such pair of parallel struts is mounted, controlling one or more motors to change the elevation of the central cabin with respect to the pair of pontoons and controlling a motor in each pontoon for moving the boat through the water.

A boat may include a central cabin, a pair of pontoons, two pairs of parallel struts each connecting the central cabin on one of the pair of pontoons, each pair of parallel struts forming a parallelogram with a section of the central cabin and a section of the pontoon across which each such pair of parallel struts is mounted, one or more motors for changing the elevation of the central cabin with respect to the pair of pontoons, a motor in each pontoon for moving the boat through the water and a pair of articulated struts responsive to the one or more motors, each articulated strut mounted at one end to a central pivot point at the top of the central cabin and mounted at the other end to a common pivot point one of the pontoons with one of struts in each pair of struts.

DETAILED DISCLOSURE OF THE PREFERRED EMBODIMENT(S)

Figure 1:
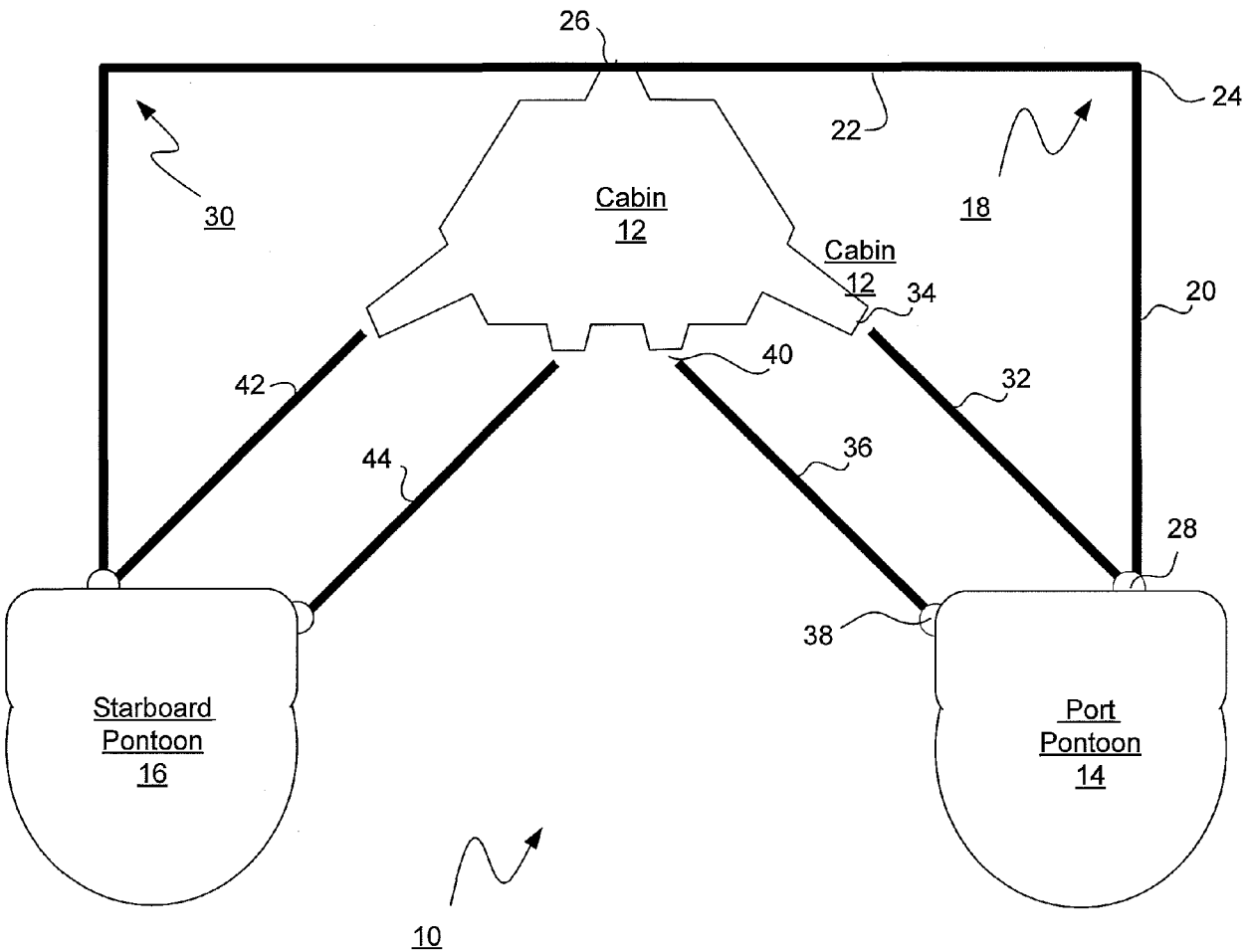
FIG. 1 is a front view of a stealthy powered catamaran in a high speed configuration.

Referring now to FIG. 1, catamaran 10 includes cabin 12 and port and starboard powered pontoons 14 and 16 mounted together by a series of articulated arms. Port upper arm 18, includes port vertical strut 20 and port horizontal strut 22 mounted together for rotation at pivot point 24. The inboard end of port horizontal strut 22 is mounted for powered rotation at split pivot point 26 at the top of cabin 12 while the lower end of vertical strut 20 is mounted for free rotation at port double pivot point 28 at the outboard upper surface of pontoon 14. Starboard upper arm 30 may be a mirror image of port upper arm 18. Port outer strut 32 is mounted for free rotation at port double pivot point 28 at one end and at port upper pivot point 34 on cabin 12 at the other end. Port lower strut 36 is mounted for free rotation at one end at port inner pivot point 38 on pontoon 14 and at the other end at port lower pivot point 40 on the lower port side of cabin 12. Starboard outer strut 42 and lower strut 44 may be mirror images of port struts 32 and 36.

In operation in this configuration, watercraft 10 may be operated at high speed through the water. Watercraft 10 will also have a relatively high clearance between the pontoons to get over floating, fixed or partially submerged obstacles. For example, pontoons or hulls 14 and 16 may be designed to be very narrow at the water line and a series of pylons or other obstacles could be fixed in position as a barrier to other watercraft not configured with the same cross section. Further, a series of barriers may be provided in the water which require that the watercraft have a first central clearance and/or distance between pontoons or hulls to pass a first set of barriers and a second central clearance and/or distance between hulls to pas a second set of barriers so that only watercraft 10 which has relatively narrow hulls and adjustable central clearance and/or distance between hulls is capable of traversing such barriers.

In the high speed mode, the arms and struts may be utilized as lift devices like wings on an air plane. Positive lift may be used to reduce the effective weight of the craft on the water while negative lift may be used to push the craft further into the water increasing the depth of the pontoons. A combination of positive and negative lefts distributed fore and aft may be used to level the craft at high speed, perhaps compensating for changes in fuel or munitions loads. Unbalanced lift, from the equivalent of ailerons in the struts and arms, may be used to steer the plane at high speed.

In the high speed mode, watercraft 10 is taller than in other modes and therefore visible at a greater distance on the water over the horizon, both visually and to radar, than it would be with cabin 12 lower to the water.

Figure 2:
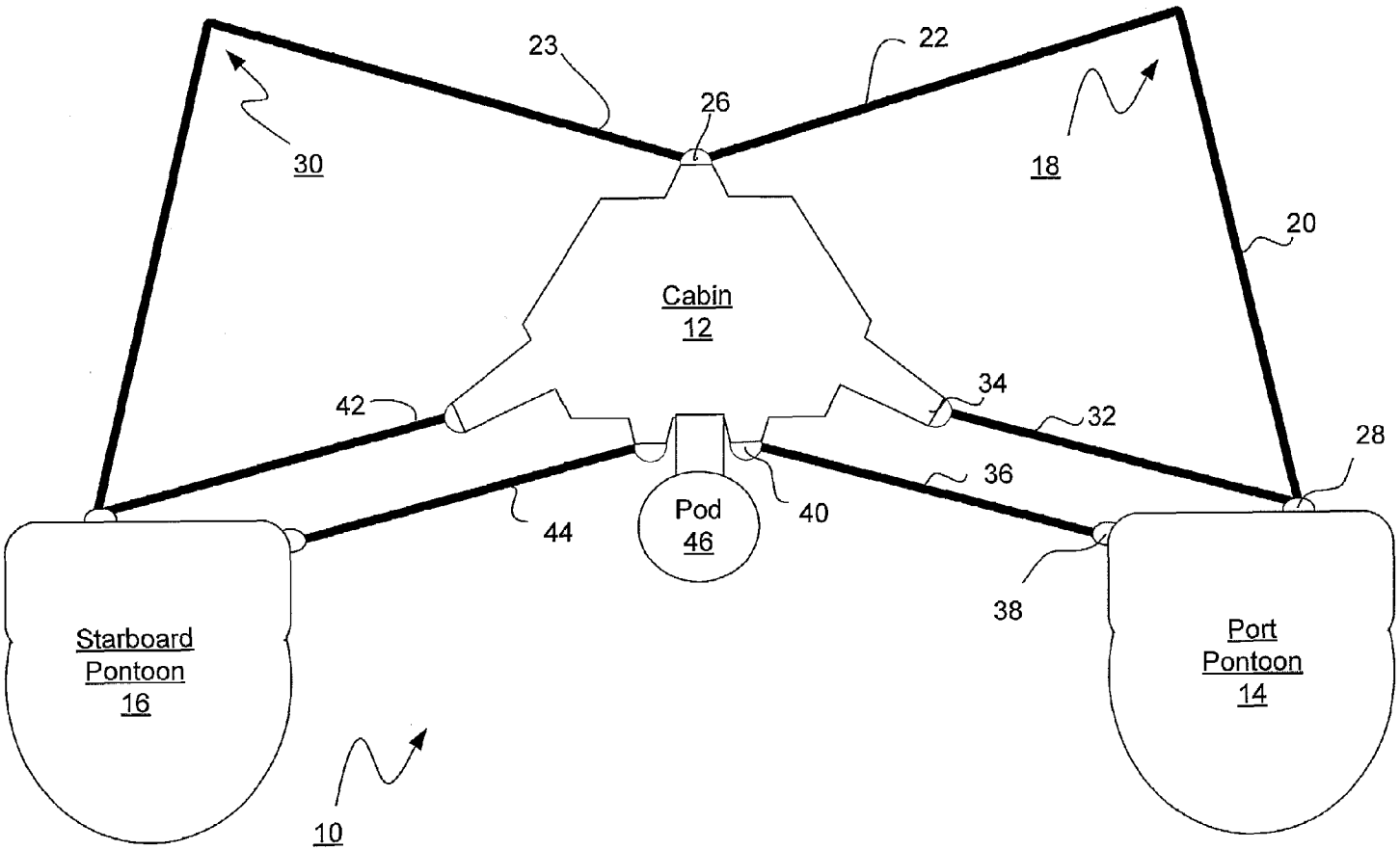
FIG. 2 is a front view of the stealthy powered catamaran of FIG. 1 in a stealthy configuration.

Referring now to FIG. 2, cabin 12 may be lowered into a relatively stealthy mode by upward rotation of port horizontal strut 22, and starboard horizontal strut 23, at split pivot point 28. This action reduces the included angles in upper arms 18 and 30 and lowers cabin 12 toward the level of pontoons 14 and 16. Port outer strut 32 and lower strut 36 may form a parallelogram with struts 32 and 36 of equal length and the distance between pivots 34 and 40 being equal to the distance between pivots 28 and 38. Struts 42 and 44 may also form a parallelogram. Cabin 12 remains centrally positioned between pontoons. Lowering of cabin 12 by reducing the included angles in arms 18 and 30 maintains pontoons 14 and 16 equidistant from cabin 12 because of the pivoted parallelogram configuration of the outer and lower struts.

In an alternate configuration, it may be desirable for the outer and lower struts to not form an exact parallelogram so that raising and lowering cabin 12 causes pontoons 14 and 16 to shift or cant slightly from the vertical. For example, in the high speed mode shown in FIG. 1, it may be desirable for the pontoons to be canted slightly outward for stability at higher speeds while retaining the pontoons in a vertical configuration for least disturbance of the water in the stealthy configuration shown in FIG. 2.

Watercraft 10 may carry a releasable pod, such as pod 46, preferably supported from a central location such as the center of cabin 12 in order to maintain balance. Pod 46 may be a munition, such as a torpedo, or a personnel carrier such as a smaller watercraft or one man submarine.

Referring now to FIGS. 1 and 2, watercraft 10 may be used in a military operation, or a simulated military operation as a toy, in which the high speed configuration may be used to position watercraft 10 in the vicinity of target at which time watercraft 10 may be reconfigured into a stealthy mode to reduce the likelihood of being detected. Once the primary task has been achieved, by for example launching (and or retrieving) pod 46, watercraft 10 may be reconfigured into the high speed mode to aid in a higher speed getaway. Intermediate configurations between the high speed and stealth configurations may also be used as appropriate. For example, during a getaway, the speed of watercraft 10 may be increased while in the stealth mode and at an appropriate speed or at an appropriate speed, the cabin may begin to be lifted towards the higher speed mode. Because the height above the water surface of cabin 12 may be adjusted, cabin 12 may also be lowered for other purposes, for example, to permit vehicle 12 to pass under an obstruction such as a bridge.

Figure 3:
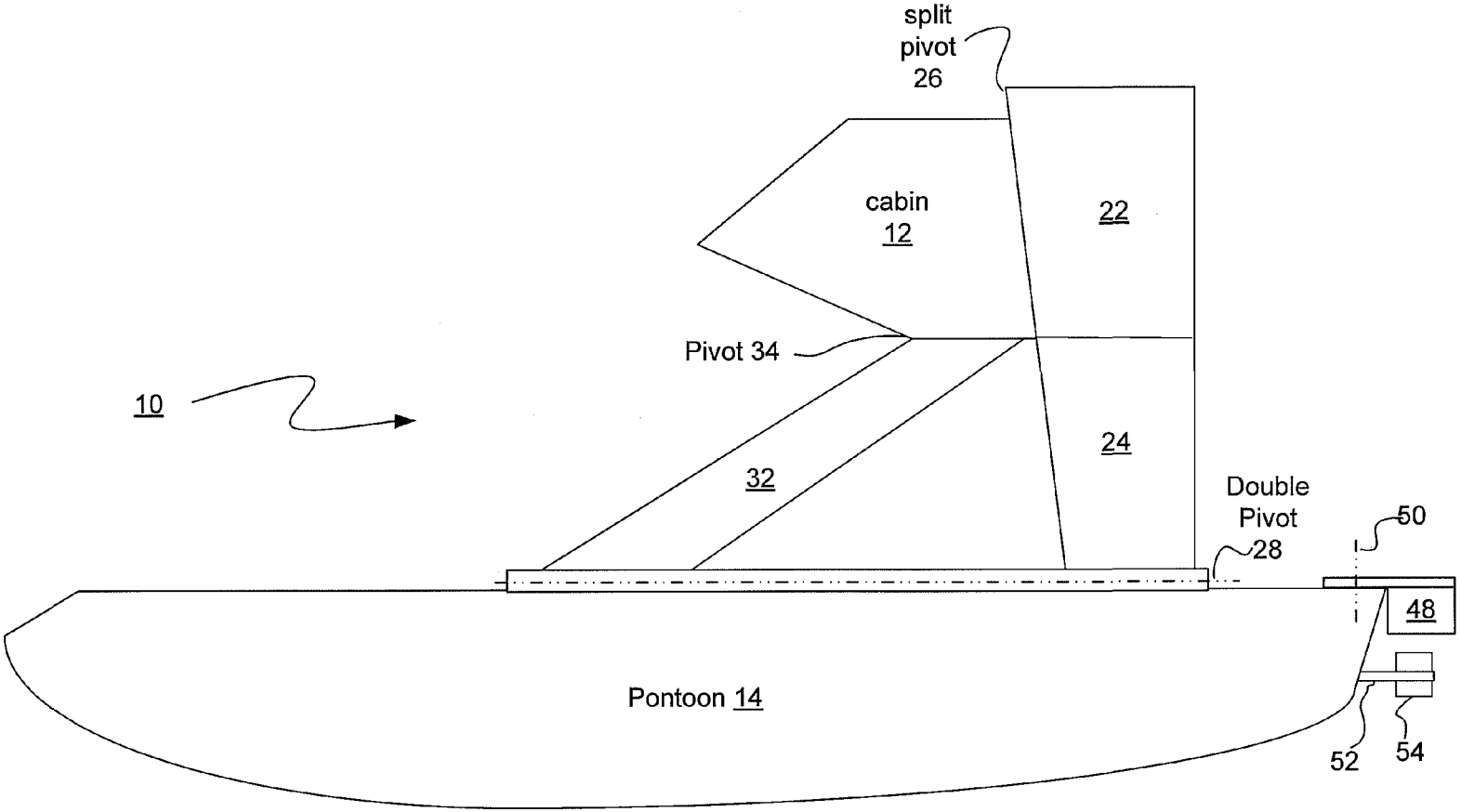
FIG. 3 is a port side view of the powered catamaran of FIG. 1 in the high speed configuration.

Referring now to FIG. 3, a port side view of watercraft 10 is shown in the elevated or higher speed configuration. At the stem of both pontoons, rudder 48 may be mounted for rotation around rudder axis 50. Propeller 54 may be mounted on engine shaft 52, driven by engines within the pontoons, to propel vehicle 12 forward. The engines in the pontoons may be operated at different speeds to aid in steering watercraft 10 and in some applications, may be used for steering in lieu of rudders. In reverse, however, it may be necessary to use only one engine to avoid tipping watercraft 10 aftwards.

Alternately, other forms of propulsion may be used. For example, water pumps or water jets similar to those used in personal watercraft may be used, together with or as alternates to propellers, to further improve the stealth qualities of watercraft 10.

Figure 4:
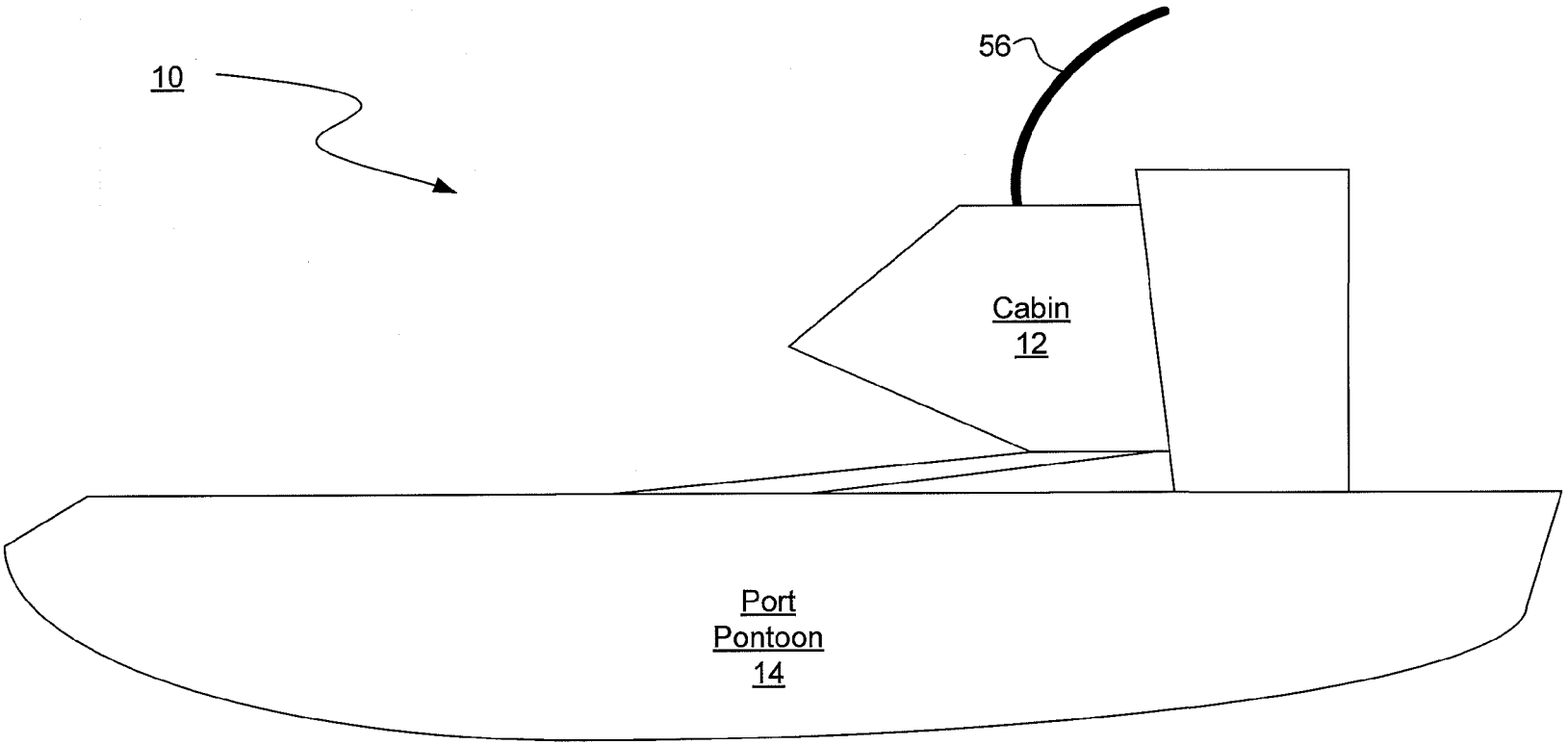
FIG. 4 is a port side view of the powered catamaran of FIG. 1 in the stealthy configuration.

Referring now to FIG. 4, a port side view of watercraft 10 is shown in the lowered or stealth mode configuration. Engines driving high speed waterjets in each of the pontoons may be operated at different speeds to aid in steering watercraft 10 and in some applications, may be used for steering in lieu of rudders. In this configuration, cabin 12 is lowered and is less visible. In particular, cabin 12 is closer to the surface of the water and therefore the curvature of the earth requires an observer to be closer to watercraft 10 before seeing it. In addition, waves on the surface of the water would likely mask a greater part of the cabin structure than they would in the elevated or high speed position shown in FIG. 3.

There are many known techniques and materials which are useful for further rendering watercraft 10 from detection by radar, such as rubber-like surface coatings which absorb and reduce reflection of radar beams and angular cross sections and shapes which reduce and redirect any reflections. These stealth enhancing techniques and materials may be beneficially used on the cabin, struts, supports and upper surfaces of watercraft 10 to increase stealth. Although such stealth enhancing techniques and materials will also benefit watercraft 10 in an elevated configuration, the lowered configuration shown in FIG. 4 reduces the overall size of the radar target further increasing stealth capabilities.

It should be noted, as may be seen from a comparison between FIGS. 1 and 2 that pontoons 14 and 16 do not have vertical surfaces in the stealth mode. For example, port upper arm 18 includes port vertical strut 20 which may be generally vertical in the elevated mode, but is much less vertical in the stealth mode, without substantially increasing any vertical component of port horizontal strut 22.

An additional advantage in the stealth mode, also visible from a comparison between FIGS. 1 and 2, is that pontoons 14 and 16 are substantially further apart. The increased width of the track between the pontoons increases stability of watercraft 10. Increased pontoon width permits the watercraft to ride any waves better and reduce motion of cabin 12 due to the waves, potentially improving stealth.

In FIG. 4, radio antenna 56 is shown mounted to the top of cabin 12. In a military and other uses, antenna 56 may be used for communication or for remote control of an unmanned vehicle.

Figure 5:
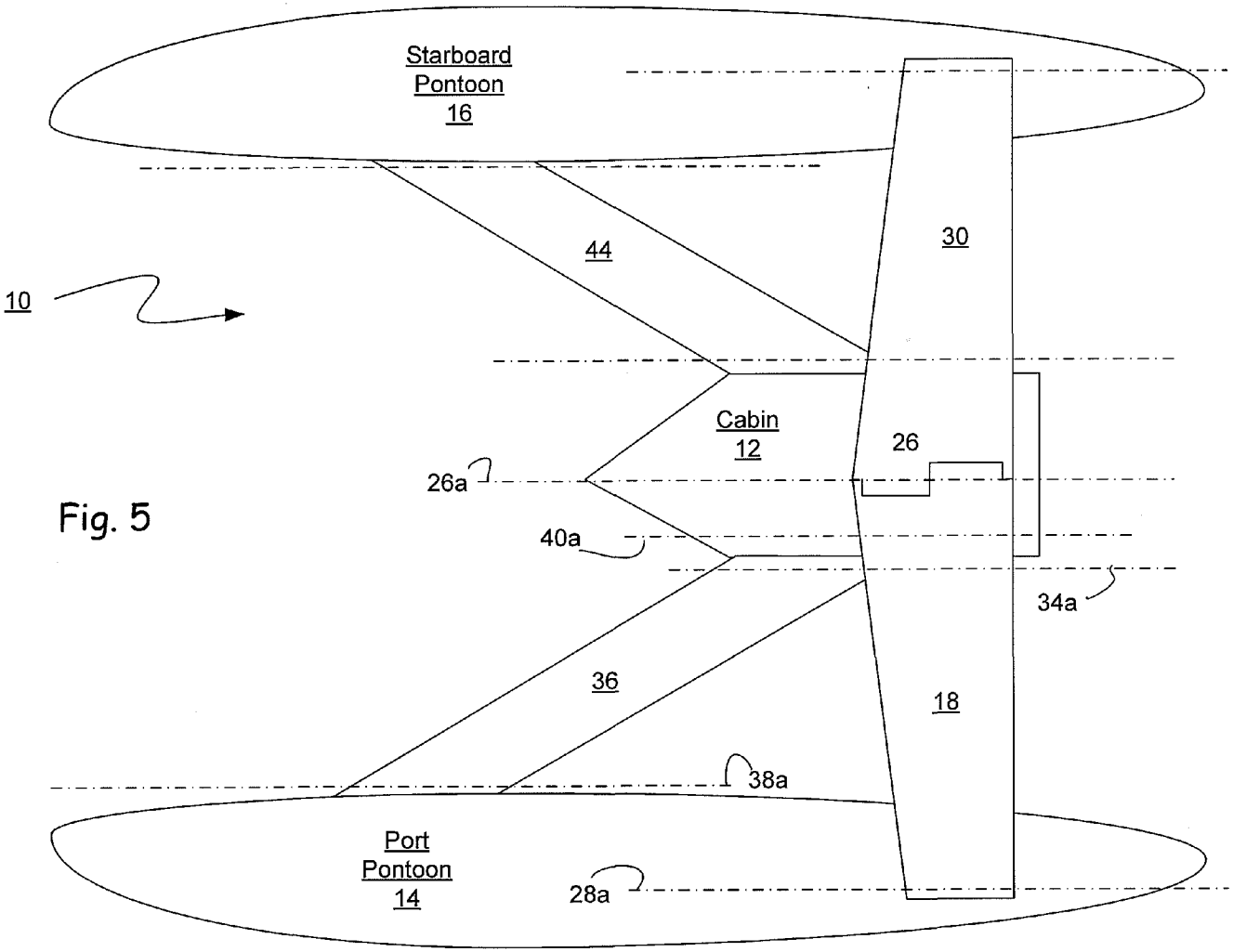
FIG. 5 is a top view of the powered catamaran of FIG. 1 in the stealthy configuration.

Referring now to FIG. 5, watercraft 10 is shown in a top view in a stealth configuration in which axis 28*a*is the axis of rotation of double hinge 28 between port upper arm 18 and port outer strut 32 with pontoon 14. Outer strut 32 is hidden from view in this figure by port upper arm 18, but visible in other figures. Double hinge 28 may be a pair of coaxial hinges or port vertical strut 20 and port outer strut 32 may be joined together and hinged to a single pivot point at hinge 28. Port lower strut 36 is hinged to cabin 12 along hinge axis 34*a* through hinge 34 and hinged to port pontoon 14 along hinge axis 38*a*through hinge 38.

Referring now also to FIG. 1, it is important to note that outer strut 32 and lower strut 36 form two opposing sides of a parallelogram as noted above. The parallelogram however, may not physically be in a single two dimensional plane. For example, the port side parallelogram includes struts 32 and 36 are clearly in non-parallel or skew planes. The other pair of opposing sides of the port parallelogram include the distance through pontoon 14 between hinges axes 28*a* and 38*a* in of hinges 28 and 38 and the distance between hinge axes 40*a* and 34*a*. The parallelogram must be in the plane of the vertical motion of cabin 12.

Figure 6:
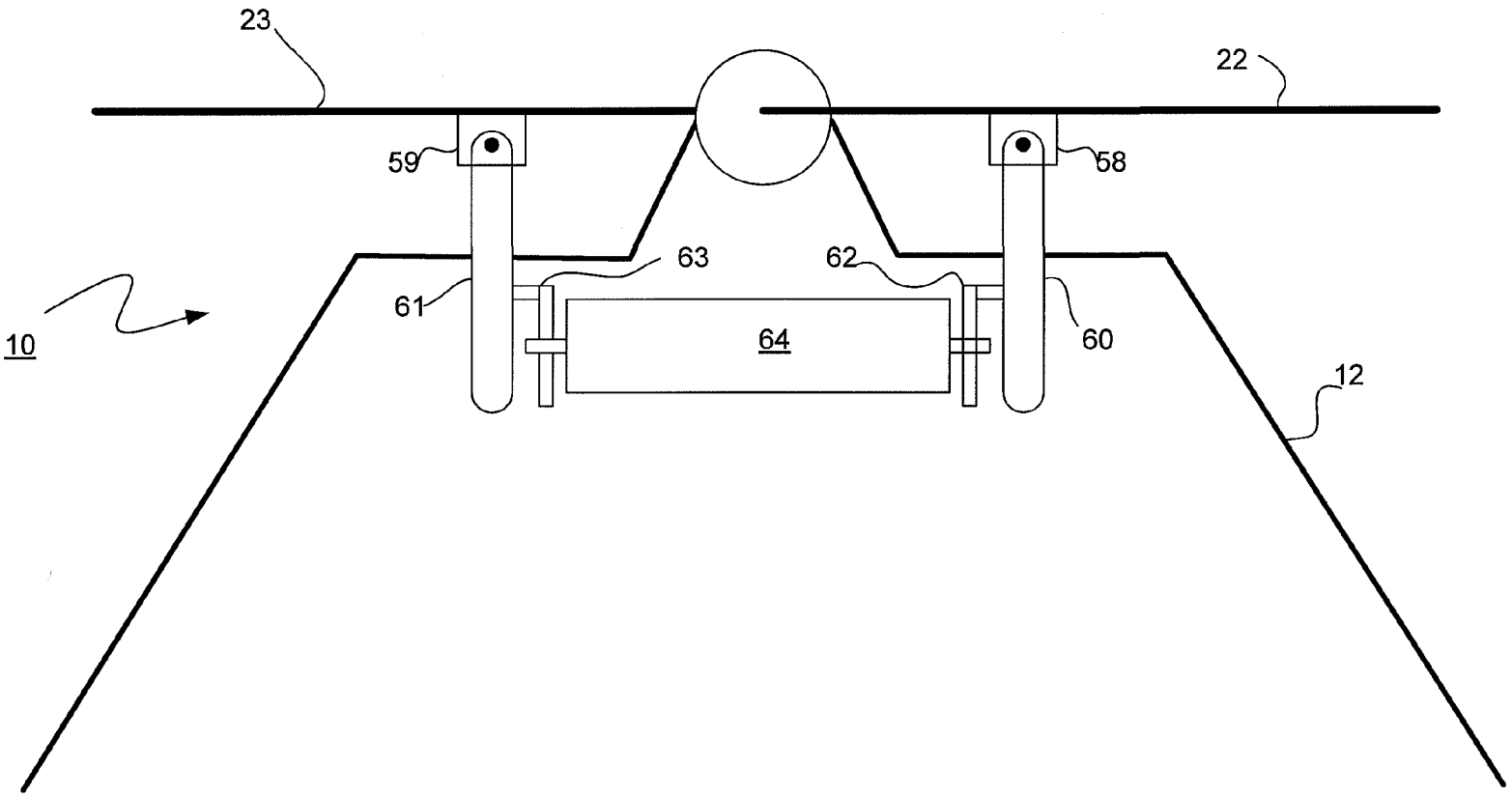
FIG. 6 is a cross sectional view of the watercraft illustrating the mechanism for raising and lowering the cabin.

Referring now to FIG. 6, an outline of the upper portion of cabin 12 is shown together with split pivot point 26. Port horizontal strut 22 is mounted for motion in pivot 26 and may include pin assembly 58 mounted to a bottom surface. Slider 60 is affixed at one end to pin 58 and is caused to move in the vertical direction by rotation motion of cam 62 driven by motor 64. Similarly, starboard horizontal strut 23 is mounted for separate motion in split pivot 26 and may include pin assembly 59 mounted to a bottom surface. Slider 61 is affixed at one end to pin 59 and is caused to move in the vertical direction by rotation motion of cam 63 driven by motor 64. Sliders 60 and 61 are caused to be raised together from the position shown in FIG. 6 and lowered together back to the horizontal position by motor 64. Other mechanisms including belts, chains and gears may be used to raise and lower horizontal struts 22 and 23, lowering and raising cabin 12 from the high speed configuration to the stealth mode. Other mechanisms, mounted for example at pivot points on pontoons 14 and 16 may also be used to raise and lower cabin 12 either solely or in conjunction with motors 60 and 64.

In operation, with horizontal struts 22 and 23 in the horizontal position as shown in FIG. 6, watercraft 10 is in the high speed configuration shown in FIG. 1. Raising horizontal struts 22 and 23 to an angle above the horizontal by causing motor 64 to raise sliders 60 and 61, causes, or allows, cabin 12 to be lowered to the stealth configuration shown in FIG. 2. Returning struts 22 and 23 to the horizontal position raises cabin 12 back to the high speed configuration.

The invention claimed is:

1. An articulated boat, comprising:

a pair of pontoons;

a central cabin;

a first pair of struts mounted at one end to a first pair of pivot points separated by a first distance along a portion of the central cabin, the first pair of struts mounted at another end to a second pair of pivot points separated by a second distance along a first portion of one of the pontoons, the first pair of struts and first and second distances forming a parallelogram, one of the struts of the first pair of struts forming an acute angle with the corresponding one of the pontoons;

a second pair of struts mounted at one end to a third pair of pivot points separated by a third distance along another portion of the central cabin, the second pair of struts mounted at another end to a pair of pivot points separated by a fourth distance along a first portion of the other one of the pontoons, the second pair of struts and the third and fourth distances and second distances forming a parallelogram;

one or more motors for changing an elevation between the central cabin and the pair of pontoons and a fifth distance between the pontoons; and a pair of engines for moving the boat through the water.

2. An articulated boat, comprising:

a pair of pontoons;

a central cabin;

a first pair of struts mounted at one end to a first pair of pivot points separated by a first distance along a portion of the central cabin, the first pair of struts mounted at another end to a second pair of pivot points separated by a second distance along a first portion of one of the pontoons, the first pair of struts and first and second distances forming a parallelogram;

a second pair of struts mounted at one end to a third pair of pivot points separated by a third distance along another portion of the central cabin, the second pair of struts mounted at another end to a pair of pivot points separated by a fourth distance along a first portion of the other one of the pontoons, the second pair of struts and the third and fourth distances and second distances forming a parallelogram;

one or more motors for changing an elevation between the central cabin and the pair of pontoons and a fifth distance between the pontoons;

a pair of engines for moving the boat through the water;

first and second struts each pivoted at one end to the central cabin;

a third strut pivoted to the other end of the first strut and pivoted to the one of the pontoons;

a fourth strut pivoted to the other end of the second strut and pivoted to the other one of the pontoons; and a pair of links powered by the one or more motors for rotating the first and second struts about their pivot points.

3. The invention of claims 1 or 2 wherein one of the struts in the first pair of struts is not in the same plane as the other of the struts in the first pair of struts.

4. The invention of claim 2 wherein the first and second struts are pivoted about the same point on the central cabin.

5. The invention of claim 2 further comprising:

a remote control for operating the one or more motors to alter the configuration of the central cabin and the pair of pontoons, and for operating the pair of engines to move the boat through the water.

6. The invention of claim 2 wherein the first and second struts are pivoted at one end to the central cabin at a common pivot point.

7. The invention of claim 2 wherein the third strut is pivoted to one of the pontoons at the same pivot point one of the second pair of struts is mounted.

8. A method of operating a boat, comprising:

providing a pair of pontoons connected to a central cabin by two pairs of parallel struts, each pair forming a parallelogram with a section of the central cabin and a section of the pontoon across which each such pair of parallel struts is mounted, one strut of each of the two pairs of struts forming an acute angle with the corresponding pontoon;

controlling one or more motors to change the elevation of the central cabin with respect to the pair of pontoons; and control a motor in each pontoon for moving the boat though the water.

9. The invention of claim 8 further comprising:

providing a pair of internally articulated struts, each articulated strut mounted at one end to a central pivot point at the top of the central cabin and mounted at the other end to a common pivot point on one of the pontoons with one of struts in each pair of struts.

10. The invention of claim 9 wherein one of the struts in each of the two pairs of parallel struts is not in the same plane as the other one of struts in the same pair.

11. The invention of claim 9, further providing:

providing a remote control for controlling the motors in each pontoon to move the boat though the water, and for controlling the one or more motors to change the elevation of the central cabin with respect to the pair of pontoons.

12. A boat, comprising:

a central cabin;

a pair of pontoons;

two pairs of parallel struts each connecting the central cabin on one of the pair of pontoons, each pair of parallel struts forming a parallelogram with a section of the central cabin and a section of the pontoon across which each such pair of parallel struts is mounted, one strut of each pair of struts forming an acute angle with the one of the pair of pontoons to which that strut is connected;

one or more motors for changing the elevation of the central cabin with respect to the pair of pontoons;

a motor in each pontoon for moving the boat through the water; and a pair of internally articulated struts responsive to the one or more motors, each articulated strut mounted at one end to a central pivot point at the top of the central cabin and mounted at the other end to a common pivot point on one of the pontoons with one of struts in each pair of struts.

13. The invention of claim 12, further comprising:

a remote control for controlling the one or more motors to control the elevation of the central cabin and for controlling the motors in each pontoon for moving the boat through the water.

14. An articulated boat, comprising:

a pair of pontoons;

a central cabin;

a first pair of struts mounted at one end to a first pair of pivot points separated by a first distance along a portion of the central cabin, the first pair of struts mounted at another end to a second pair of pivot points separated by a second distance along a first portion of one of the pontoons, the first pair of struts and first and second distances forming a parallelogram;

a second pair of struts mounted at one end to a third pair of pivot points separated by a third distance along another portion of the central cabin, the second pair of struts mounted at another end to a pair of pivot points separated by a fourth distance along a first portion of the other one of the pontoons, the second pair of struts and the third and fourth distances and second distances forming a parallelogram;

one or more motors for changing an elevation between the central cabin and the pair of pontoons and a fifth distance between the pontoons; and a pair of engines for moving the boat through the water;

wherein the first and second struts are pivoted about the same point on the central cabin.

* * * * *